US005393203A

United States Patent [19]

Hantle

[11] Patent Number: 5,393,203

[45] Date of Patent: Feb. 28, 1995

[54] FUEL PUMP FOR MOTOR VEHICLE

[75] Inventor: Edward A. Hantle, Caro, Mich.

[73] Assignee: General Motors Corporation, Detroit, Mich.

[21] Appl. No.: 169,122

[22] Filed: Dec. 20, 1993

[51] Int. Cl.[6] ..... F04B 23/14

[52] U.S. Cl. ..... 417/203; 417/205; 417/423.4; 417/423.6; 417/410.4

[58] Field of Search ..... 417/201, 203, 205, 423.4, 417/423.6, 410 C, 244, 319

[56] References Cited

U.S. PATENT DOCUMENTS

| | | | |
|---|---|---|---|
| 2,055,587 | 9/1936 | Pigott | 417/203 |
| 3,658,444 | 4/1972 | Rhodes et al. | 417/423 |
| 4,295,797 | 10/1981 | Ruhl | 417/205 X |
| 4,336,002 | 6/1982 | Rose et al. | 417/203 |
| 4,445,820 | 5/1984 | Hayashi et al. | 417/366 |
| 4,573,882 | 4/1986 | Watanabe et al. | 417/366 |
| 4,718,827 | 1/1988 | Sutton | 417/244 |
| 4,958,984 | 9/1990 | Aoi et al. | 415/55.1 |
| 4,969,806 | 11/1990 | Nusser | 417/410 |
| 4,978,282 | 12/1990 | Fu et al. | 417/360 |
| 5,006,048 | 4/1991 | Jow | 417/410 C |
| 5,129,796 | 7/1992 | Emmert et al. | 417/435 |

FOREIGN PATENT DOCUMENTS

| | | | |
|---|---|---|---|
| 2745800 | 4/1979 | Germany | 417/203 |

*Primary Examiner*—Richard E. Gluck
*Attorney, Agent, or Firm*—Saul Schwartz

[57] ABSTRACT

A motor vehicle fuel pump including a tubular shell, an electric motor in the shell having an armature shaft rotatable about a longitudinal centerline of the shell, and a pump assembly at one end of the shell having a first rotatable element therein and a second element therein between the first rotatable element and the electric motor. A barrel-shaped driver in a cavity between the first and second rotatable elements includes drive lugs on each longitudinal end projecting into corresponding drive sockets in the first and second rotatable elements. Each drive lug has a rounded edge engaging a side of the corresponding drive socket such that the driver is effectively decoupled from the first and second rotatable elements except with respect to force reactions establishing torsional force couples on the rotatable elements in planes perpendicular to the longitudinal centerline of the shell. The armature shaft has a distal end defining a drive tang received in a correspondingly shaped cavity in the barrel-shaped driver.

5 Claims, 2 Drawing Sheets

FUEL PUMP FOR MOTOR VEHICLE

FIELD OF THE INVENTION

This invention relates to fuel pumps for motor vehicles.

BACKGROUND OF THE INVENTION

A motor vehicle fuel pump described in U.S. Pat. No. 4,445,820 includes and electric motor and a pair of closed-vane regenerative turbine pumps. The electric motor has an armature shaft rotatable about a longitudinal centerline of the pump and each turbine pump has a disc-shaped impeller rotatable about the longitudinal centerline of the pump independently of the armature shaft. A driver attached to an end of the armature shaft has a pair of bifurcated arms extending serially through apertures in the impellers whereby the impellers are drivingly connected to the armature shaft. A motor vehicle fuel pump according to this invention includes a driver of improved construction relative to the driver in the aforesaid U.S. Pat. No. 4,445,820 for drivingly connecting an electric motor armature shaft to a pair of rotatable elements in the pump.

SUMMARY OF THE INVENTION

This invention is a new and improved motor vehicle fuel pump including a tubular shell, an electric motor in the shell having an armature shaft rotatable about a longitudinal centerline of the shell, a pump assembly at one end of the shell having a first element therein rotatable in a plane perpendicular to the longitudinal centerline and a second element therein between the first rotatable elements and the electric motor and likewise rotatable in a plane perpendicular to the longitudinal centerline. A barrel-shaped driver is disposed in a cavity between the first and second rotatable elements and includes drive lugs on each longitudinal end projecting into corresponding drive sockets in the first and second rotatable elements. Each drive lug has a rounded edge engaging a side of the corresponding drive socket such that the driver is effectively decoupled from the first and second rotatable elements except with respect to force reactions establishing torsional force couples on the rotatable elements in planes perpendicular to the longitudinal centerline of the shell. The armature shaft has a distal end defining a drive tang received in a correspondingly shaped cavity in the barrel-shaped driver. The aforesaid decoupling of the driver from the rotatable elements minimizes the propensity for the rotatable elements to bind against non-rotating elements of the pump in the presence of tolerance induced misalignment between the rotatable and non-rotatable elements.

BRIEF OF THE DESCRIPTION

DESCRIPTION OF A PREFERRED EMBODIMENT

Figure 1:
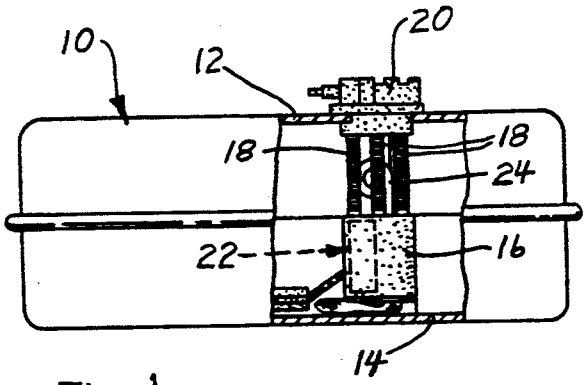
FIG. 1 is a partially broken-away view of a motor vehicle fuel tank having disposed therein a fuel pump according to this invention.

Referring to FIG. 1, a fuel tank 10 of a motor vehicle, not shown, has a top panel 12 and a bottom panel 14. A reservoir 16 is disposed inside the fuel tank and biased against the bottom panel 14 by a plurality of springs 18 mounted on a corresponding plurality of struts, not shown, which connect the reservoir 16 to a cover 20 on the top panel 12. A fuel pump 22 according to this invention is disposed inside the reservoir and communicates with an engine, not shown, of the vehicle through a high pressure hose 24 inside the fuel tank and through external high pressure conduits, not shown, between the cover 20 and the engine. Surplus fuel is returned to the reservoir through external low pressure conduits, not shown, and through the aforesaid struts as described in U.S. Pat. No. 4,945,884, issued Aug. 7, 1990 and assigned to the assignee of this invention.

Figure 3:
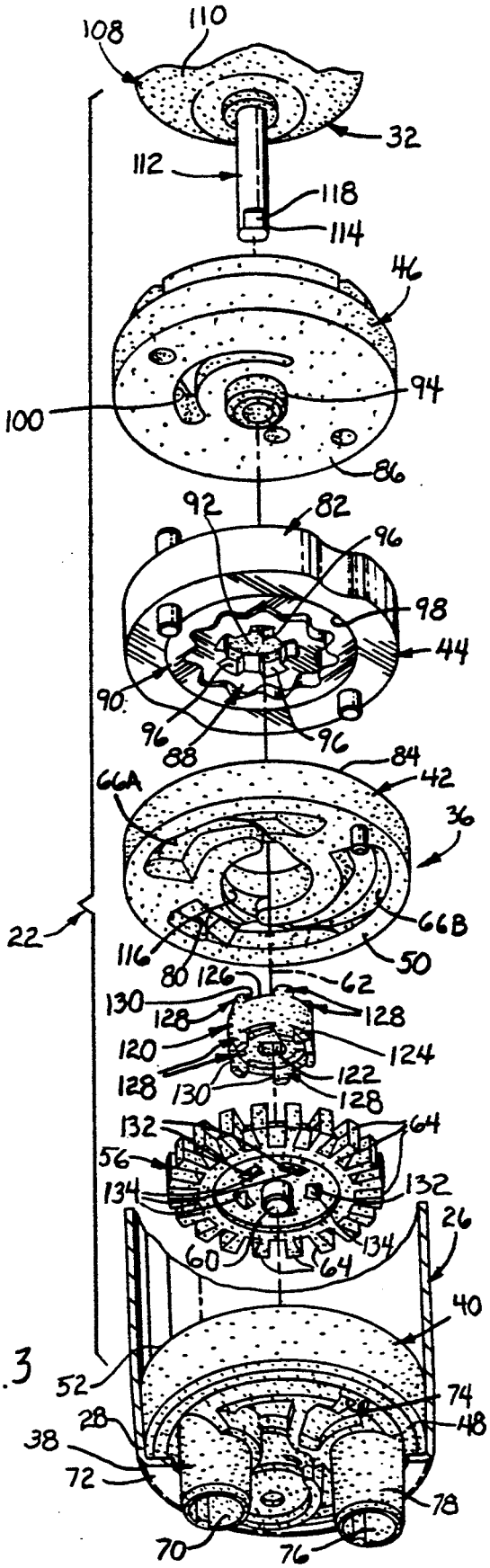
FIG. 3 is a fragmentary, exploded, perspective view of a fuel pump according to this invention.
Figure 2:
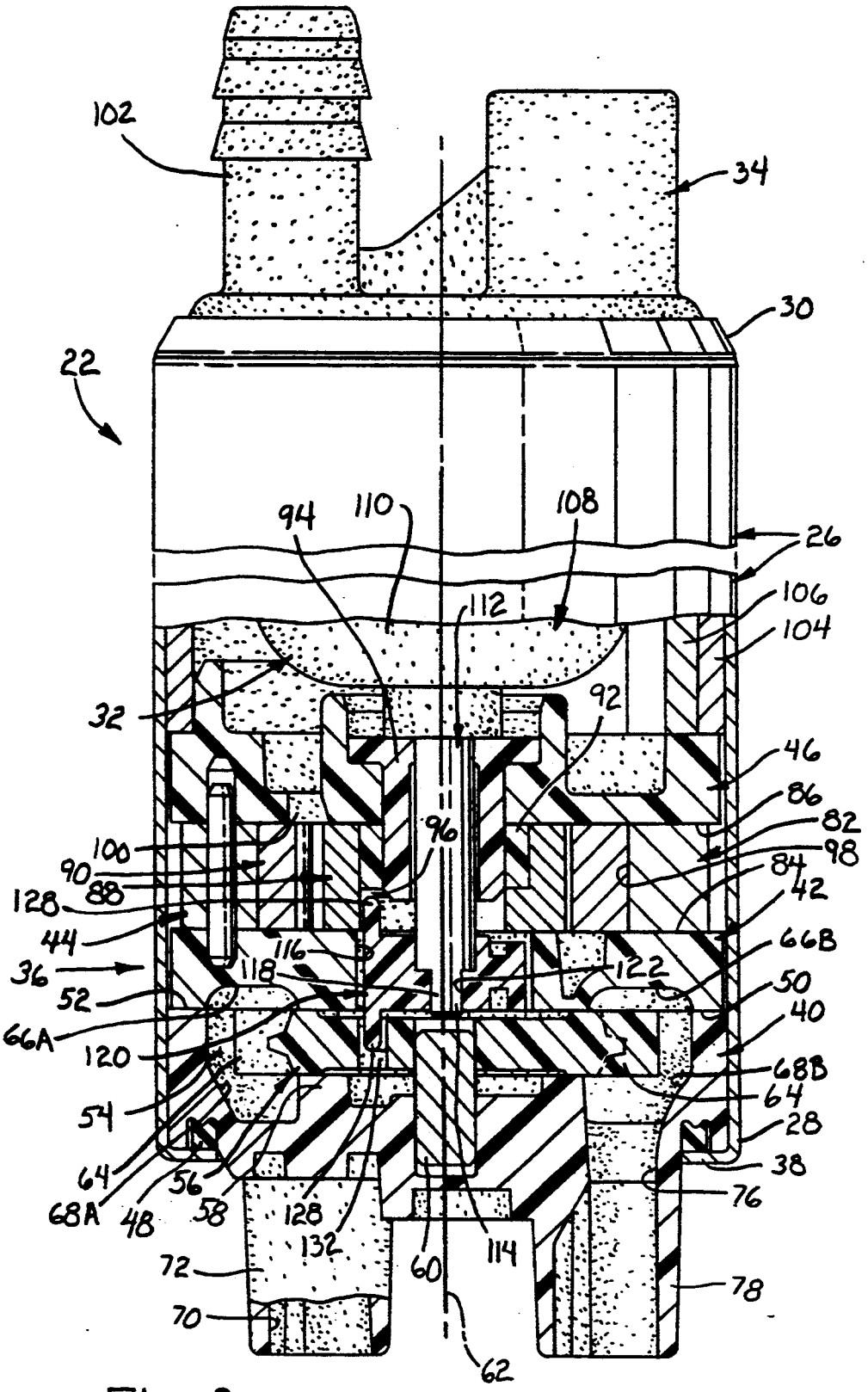
FIG. 2 is a fragmentary, partially broken-away view of a fuel pump according to this invention.

As seen best in FIGS. 2–3, a tubular shell 26 of the fuel pump 22 has an inlet end 28 and a discharge end 30. An electric motor 32 of the fuel pump is disposed in the shell 26 between a discharge end housing 34 closing the discharge end 30 and a pump assembly 36 closing the inlet end 28. An annular lip 38 of the shell 26 prevents dislodgement of the internal elements of the fuel pump through the inlet end. The opposite end of the shell is permanently deformed over the discharge end housing 34 to prevent dislodgement of the internal elements of the fuel pump through the discharge end 30 of the shell.

The pump assembly 36 includes a first end housing 40, a separator 42, a gerotor pump group 44, and a second end housing 46. The first end housing 40 is generally disc-shaped and closely received in the shell 26 with a seal ring 48 on the first end housing bearing against the lip 38 on the shell. The separator 42 is similarly disc-shaped and closely received in the shell 26 with a lower flat side 50 bearing against an upper flat side 52 of the first end housing 40. An impeller cavity 54 in the first end housing faces and is closed by the lower flat side 50 of the separator 42.

A first rotatable element of the pump assembly 36 in the form of a disc-shaped impeller 56 is disposed in the impeller cavity 54 between the flat side 50 and an annular boss 58 at the bottom of the impeller cavity. The impeller 56 is supported on pin-like shaft 60 on the first end housing 40 for rotation about a longitudinal centerline 62 of the shell and has a plurality of open-vane impeller vanes 64, FIGS. 2–3, around its periphery. The vanes 64 cooperate with a pair of am-shaped grooves 66A–B in the lower side 50 of the separator and a corresponding pair of arc-shaped grooves 68A–B in the bottom of the impeller cavity 54 outboard of the boss 58 in defining a pair of regenerative turbine pump channels.

A passage 70 in the first end housing is surrounded by tubular boss 72 thereon and communicates with a first of the aforesaid pair of regenerative turbine pump channels defined by grooves 66A,68A and with the fuel tank 10 outside the reservoir 16. The first passage 70 defines a new fuel inlet from the fuel tank to the first pump channel. An aperture 74, FIG. 3, in the first end housing 40 communicates with a second end of the first pump channel and with the reservoir 16 and defines a discharge for new fuel from the pump channel into the reservoir.

A passage 76 in the first end housing 40 extends through a second tubular boss 78 on the first end housing and effects communication between the reservoir and a first end of a second one of the aforesaid pair of regenerative turbine pump channels defined by the grooves 66B,68B. A passage 80, FIG. 3, in the separator 42 defines a flow path across the separator from a second end of the second pump channel. When the impeller 56 rotates clockwise, FIG. 3, about the centerline 62, fluid flow from the fuel tank into the reservoir is induced in the first pump channel and fluid flow from the reservoir to the passage 80 is induced in the second pump channel.

The gerotor pump group 44 includes a stationary ring 82 between an upper flat side 84 of the separator 42 and an inboard flat side 86 of the disc-shaped second end housing 46, an externally toothed inner ring 88, and an internally toothed outer ring 90. A bushing 92 at the center of the inner ring is received on the outside diameter of a tubular ferrule 94 mounted on the second end housing 46 whereby the inner ring is supported on the shell 26 for rotation about the centerline 62 and constitutes a second rotatable element of the pump assembly 36. A plurality of generally rectangular internal spline teeth on the inner ring 88 define a corresponding plurality of generally rectangular notches 96 in the inner ring arrayed in a circle around the centerline 62 and facing the separator 42.

As seen best in FIG. 3; an inner cylindrical wall 98 of the stationary ring 82 supports the outer ring 90 on the shell 26 for rotation about an axis parallel to but slightly offset from the centerline 62. In conventional gerotor pump fashion, the teeth on the inner and outer rings 88,90 mesh and define a crescent-shaped inlet zone and a crescent-shaped discharge zone of the gerotor pump group. The inlet zone is aligned with the passage 80 in the separator 42. The discharge zone is aligned with a discharge port 100 in the second end housing 46. When the inner ring 88 rotates clockwise, FIG. 3, about the centerline 62, fluid flow is induced from the passage 80 into the interior of the shell 26 through the discharge port 100. Fuel discharges from the shell 26 through a tubular connector 102 on the end housing 34, FIG. 2.

The electric motor 32 of the fuel pump 22 includes a flux ring 104 in the shell 26 abutting the second end housing 46, a plurality of permanent magnets 106 on the flux ring, and an armature 108. The armature 108 includes a wire wound core 110 on an armature shaft 112 aligned on the centerline 62. At a first end, not shown, the armature shaft is supported on the discharge end housing 34 for rotation about the centerline 62. Adjacent a second end 114, FIGS. 2–3, a cylindrical portion of the armature shaft 112 is journaled by the ferrule 94 for rotation about the centerline 62.

Figure 4:
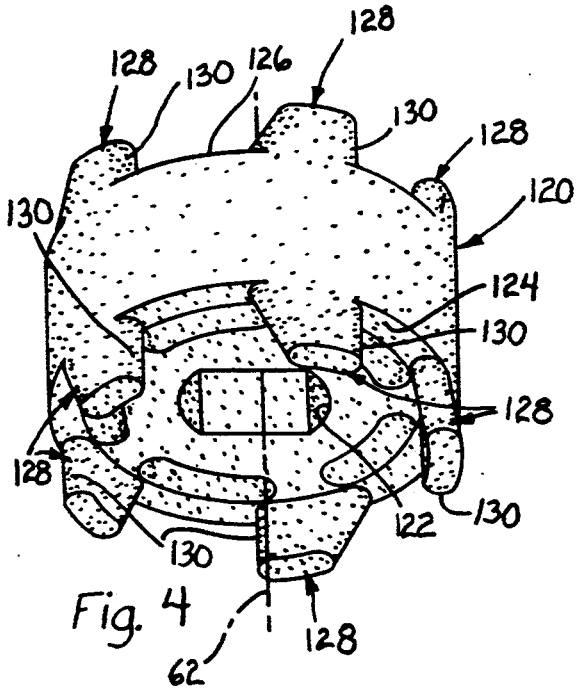
FIG. 4 is an enlarged perspective view of a portion of FIG. 3.

As seen best in FIGS. 2–4, a cylindrical bore 116 in the separator 42, symmetric about the longitudinal centerline 62, defines a driver chamber between the first rotatable element or impeller 56 and the second rotatable element or inner ring 88. The second end 114 of the armature shaft 112 projects into the driver chamber and is flattened to define a drive tang 118 of so-called double-D shape.

A barrel-shaped driver 120 is disposed in the driver chamber and has a double-D cavity 122 therein which closely receives the drive tang 118 so that the driver is drivingly connected to the armature shaft 112, i.e. rotatable as a unit with the armature shaft about the longitudinal centerline 62. The barrel-shaped driver 120 includes a first circular edge 124 facing the impeller 56 and a second circular edge 126 facing the inner ring 88. Each of the first and second circular edges 124,126 of the driver has formed thereon a plurality of short, buttress-shaped drive lugs 128. Each drive lug has a rounded or radiused driving edge 130 parallel to the centerline 62.

The impeller 56 has a plurality of generally rectangular windows 132 arrayed in a circle radially inboard of the aforesaid arc-shaped pump channels. The windows 132 define sockets which loosely receive corresponding ones of the drive lugs 128 on the first edge 124 of the driver. Each window has a generally radial side 134 engaged by the radiused edge 130 of the corresponding lug 128 when the driver 120 is rotated clockwise, FIG. 3, about the centerline 62. Because the windows 132 are oversize relative to the lugs 128, the force reactions of the radiused edges 130 on the sides 134 of the windows resolve into only torsional moments on the impeller 56 in the plane thereof about the centerline 62. The impeller is, therefore, effectively decoupled from the driver with respect to other force reactions attributable to tolerance induced misalignment between the impeller 56 and the driver 120.

Similarly, the notches 96 in the inner ring 88 define a corresponding plurality of windows, i.e. sockets, in the inner ring which loosely receive corresponding ones of the drive lugs 128 on the second edge 126 of the driver. Each notch 96 has a generally radial side engaged by the radiused edge 130 of the corresponding drive lug 128 when the driver 120 is rotated clockwise, FIG. 3, about the centerline 62. Because the notches 96 are oversize relative to the lugs 128, the force reactions of the radiused edges 130 on the sides of the notches resolve into only torsional moments on the inner ring 88 in the plane thereof about the centerline 62. The inner ring is, therefore, effectively decoupled from the driver with respect to other force reactions attributable to tolerance induced misalignment between the inner ring and the driver.

In operation, when the electric motor is turned on, the armature shaft 112 rotates clockwise, FIG. 3, and drives each of the first and the second rotatable elements of the pump clockwise as a unit therewith through the driver 120. Fuel is pumped by the first rotatable element from the fuel tank into the reservoir 16 and from the reservoir to the inlet arc of the gerotor pump group. Concurrently, fuel is pumped by the second rotatable element from the inlet arc to the interior of the shell 26 through the discharge port 100 and out through the connector 102 on the discharge end housing 34. The short height of each drive lug 128 parallel to the centerline 62 relative to its length in the circumferential direction of the driver contributes to maximum drive lug durability.

While this invention has been described in terms of a preferred embodiment thereof, it will be appreciated that other forms could readily be adapted by one skilled in the art. Accordingly, the scope of this invention is to be considered limited only by the following claims.

The embodiments of the invention in which an exclusive property or privilege is claimed are defined as follows:

1. In a motor vehicle fuel pump including a tubular shell an electric motor in said Shell having an armature shaft rotatable about a centerline of said shell, a first pump means in said shell at an inlet end thereof having a first rotatable element therein, and a second pump means in said shell having a second rotatable element therein between said first rotatable element and said electric motor, the combination comprising:

means defining a driver chamber between said first and said second rotatable elements, a barrel-shaped driver in said driver chamber having a first edge facing said first rotatable element and a second edge facing said second rotatable element, means defining a plurality of drive sockets in said first rotatable element each having a side extending generally radially relative to said centerline of said shell, means defining a plurality of first drive lugs on said first circular edge of said driver extending into corresponding ones of said drive sockets in said first rotatable element, means defining a plurality of drive sockets in said second rotatable element each having a side extending generally radially relative to said centerline of said shell, means defining a plurality of second drive lugs on said second circular edge of said driver extending into corresponding ones of said drive sockets in said second rotatable element, means on each of said first plurality of drive lugs and on said second plurality of drive lugs defining a drive edge parallel to said centerline of said shell and engageable on said side of the corresponding one of said drive sockets when said driver rotates in a first direction about said centerline of said shell, and means connecting said driver to said armature shaft for rotation as a unit therewith in said first direction about said centerline of said shell.

2. The motor vehicle fuel pump recited in claim 1 wherein:

said drive edge on each of said first plurality of drive lugs and on said second plurality of drive lugs is rounded so that the force reactions of all of said drive edges on corresponding ones of said sides of said drive sockets resolve substantially only into torsional force couples on each of said first and said second rotatable elements in planes substantially perpendicular to said centerline of said shell.

3. The motor vehicle fuel pump recited in claim 2 wherein said means connecting said driver to said armature shaft for rotation as a unit therewith includes means on said driver defining a cavity aligned on said centerline of said shell having a flat side extending parallel to a said centerline, and means defining a tang on an end of said armature shaft having a shape corresponding to the shape of said cavity in said driver including a flat side extending parallel to said centerline of said shell and received in said cavity in said driver so that said flat side on said tang is juxtaposed side flat side of said cavity.

4. The motor vehicle fuel pump recited in claim 3 wherein:

said first pump means includes a regenerative turbine pump having said first rotatable element consisting of a disc-shaped impeller having a plurality of open-vane impeller vanes around a periphery thereof.

5. The motor vehicle fuel pump recited in claim 4 wherein:

said second pump means is a gerotor pump group having said second rotatable element consisting of an inner ring having a plurality of outside gear teeth thereon coacting with a plurality of inside gear teeth on an outer ring of said gerotor pump group supported on said shell for rotation about an axis parallel to and laterally offset from said centerline of said shell.

* * * * *